US012729414B2

(12) United States Patent
Junge et al.

(10) Patent No.: US 12,729,414 B2
(45) Date of Patent: Sep. 8, 2026

(54) METHOD FOR MODIFYING FINISHED SURFACES WITH THE AIM OF IMPROVED SURFACE PROPERTIES

(71) Applicant: ThyssenKrupp Steel Europe AG, Duisburg (DE)

(72) Inventors: Fabian Junge, Wesel (DE); Vanessa Husien Said, Dortmund (DE); Robin Dohr, Voerde (DE); Burak William Cetinkaya, Dortmund (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 350 days.

(21) Appl. No.: 18/279,404

(22) PCT Filed: Feb. 25, 2022

(86) PCT No.: PCT/EP2022/054760
§ 371 (c)(1),
(2) Date: Aug. 30, 2023

(87) PCT Pub. No.: WO2022/184565
PCT Pub. Date: Sep. 9, 2022

(65) Prior Publication Data

US 2024/0191320 A1 Jun. 13, 2024

(30) Foreign Application Priority Data

Mar. 4, 2021 (DE) ..... 10 2021 105 207.6

(51) Int. Cl.

| | |
|---|---|
| ***C21D 10/00*** | (2006.01) |
| ***C21D 7/02*** | (2006.01) |
| ***C23C 2/06*** | (2006.01) |
| ***C23C 2/28*** | (2006.01) |
| ***C23C 2/40*** | (2006.01) |
| ***C25D 3/22*** | (2006.01) |
| ***C25D 5/48*** | (2006.01) |
| ***C25D 7/06*** | (2006.01) |

(52) U.S. Cl.
CPC ..... *C21D 10/00* (2013.01); *C21D 7/02* (2013.01); *C23C 2/06* (2013.01); *C23C 2/28* (2013.01); *C23C 2/40* (2013.01); *C25D 3/22* (2013.01); *C25D 5/48* (2013.01); *C25D 7/0614* (2013.01)

(58) Field of Classification Search
CPC .... C23C 2/06; C23C 2/28; C23C 2/40; C23C 2/26; C21D 8/0278; C21D 10/00; C21D 7/02; C25D 3/22
See application file for complete search history.

(56) References Cited

U.S. PATENT DOCUMENTS

| | | | |
|---|---|---|---|
| 4,479,832 | A | 10/1984 | Hart et al. |
| 5,182,000 | A | 1/1993 | Antonelli et al. |
| 5,236,574 | A | 8/1993 | Oshima et al. |
| 2015/0125714 | A1 | 5/2015 | Amorim et al. |
| 2015/0352825 | A1 | 12/2015 | Richard et al. |

FOREIGN PATENT DOCUMENTS

| | | | | |
|---|---|---|---|---|
| CN | 102363875 | A * | 2/2012 | |
| DE | 19951133 | A1 | 4/2001 | |
| EP | 2824213 | A1 | 1/2015 | |
| KR | 100815811 | B1 * | 3/2008 | ..... C23C 2/40 |
| KR | 20100075185 | A | 7/2010 | |
| WO | 2005028695 | A1 | 3/2005 | |
| WO | 2013160867 | A1 | 10/2013 | |

OTHER PUBLICATIONS

English Abstract and English Machine Translation of Kwak (KR 100815811 B1) (Mar. 20, 2008).*
English Abstract and English Machine Translation of Xu (CN 102363875 A) (Feb. 29, 2012).*
Chinese Search Report for CN Application No. 2022800189247 mailed Jul. 18, 2025.
Bernd Meuthen et al., "Coil Coating: Bandbeschichtung—Verfahren Produkte Markte_Substrate und Beschichtungen", Dec. 31, 2012.
Duchoslav, J. et al., "The effect of plasma treatment on the surface chemistry and structure of ZnMgAl coatings", Applied Surface Science, Oct. 28, 2019.
International Search Report and Written Opinion for International Application No. PCT/EP2022/054760 mailed May 19, 2022.
Maeda, S., "Surface chemistry of galvanized steel sheets relevant to adhesion performance", Process in Organic Coatings, Jan. 1, 1996.
Neba, G., "Stahlband und seine Oberflächenveredelung, Steel Strip and its surface finishing", ThyssenKrupp Steel AG, 2023.
Pohl, K. et al., "Adsorption and stability of self-assembled organophosphonic acid monolayers on plasma modified Zn—Mg—Al alloy", Surface and Coatings Technology, Jan. 4, 2013.

* cited by examiner

*Primary Examiner* — Jessee R Roe
(74) *Attorney, Agent, or Firm* — RMCK Law Group PLC

(57) ABSTRACT

The present disclosure relates to a method for producing a semifinished product with modified surface, comprising at least one method step of at least regionally modifying the surface of a coated, skin-pass-rolled, oiled, cleaned metallic steel substrate via low-pressure or atmospheric-pressure plasma treatment of said surface regions with oxygen, argon or a mixture of oxygen and argon as process gas. The present disclosure further relates to the accordingly produced semi-finished products and/or flat steel products, optionally formed semifinished products and/or flat steel products, and also to their use.

13 Claims, 2 Drawing Sheets

METHOD FOR MODIFYING FINISHED SURFACES WITH THE AIM OF IMPROVED SURFACE PROPERTIES

CROSS-REFERENCE TO RELATED APPLICATIONS

This application is a 371 U.S. National Stage of International Application No. PCT/EP2022/054760 filed Feb. 25, 2022 which claims the benefit of German Patent Application No. 10 2021 105 207.6 filed Mar. 4, 2021. The disclosures of each of the above applications are incorporated herein by reference in their entirety.

The invention relates to a method for producing a semifinished product with modified surface, comprising at least one method step of at least regionally modifying the surface of a coated, skin-pass-rolled, oiled, cleaned metallic steel substrate via low-pressure or atmospheric-pressure plasma treatment of said surface regions with oxygen, air, argon, forming gas or a mixture of oxygen and argon, oxygen and air as process gas. The invention further relates to the accordingly produced semifinished products and/or flat steel products, optionally formed semifinished products and/or flat steel products, and also to their use.

The addition of alloy elements to hot-dip coatings has a great effect on the chemical composition in the near-surface region. The composition of the near-surface region in turn has a large effect on the steps of further processing such as pretreatments, adhesive bonding, phosphating and/or painting.

If new materials systems or surface systems are introduced, the near-surface composition may mean that they are not optimally covered by the existing process window, in an automobile process, for example. This may in turn negatively impact properties such as paint adhesion or the fracture characteristics of bonded surfaces, with the consequence that new materials/surfaces cannot be employed or the existing process window has to be adapted, causing inconvenience. Metal coatings (especially when applied by the hot-dip method) differ in their cleaning characteristics as a result of their differing surface chemistry and surface topography. As a result of this, after having passed through a cleaning operation, with the same process parameters, different metal coatings exhibit differences in their wettability with aqueous media. An assumed reason for this is the chemical composition of the carbon-containing residues covering the metal coatings. Wettability with aqueous media, however, is a key criterion for wet-chemical pre- and aftertreatment systems, which are applied, for example, by a coil-coating process. It is therefore necessary to adapt as many as possible of the surfaces employed to date, but also new surfaces, in respect of the metallic coating, to allow them to be nevertheless optimally treated with the existing process window.

The situation is similar for electrolytically galvanized substrates (ZE) as well.

Ideally, materials and surface systems, both for typical automobile processes and for the coil-coating process, must equally be integrated into the standard process. In order to guarantee this, the water wetting behavior of the surface systems is a key criterion. Only if adhesion promoters, forming aids, activating or passivating pre-/aftertreatments are applied homogeneously and comprehensively are they able to fulfil the full extent of their function. In the case of Z or ZM surfaces, for example, water wettability deteriorates within 48 h on air contact or instantaneously on direct contact with oils or other media, such as organic solvents, for example. Owing to the short contact times and the fully optimized process in the automobile process or else in the coil coating (CC) process, there are great difficulties in re-establishing the wettability of Z or ZM surfaces. These difficulties may be manifested, for example, in phosphating spots. Furthermore, as a result of the process, during coil coating, superstructures may appear in the wet film of the pretreatment solution on various metal coatings. These structures may also remain after the pretreatment has dried up, and are suspected of leading to adhesion problems in the painting process.

Known from the prior art are a number of approaches to the modification of the near-surface region of a metal coating on steel substrates, which serve to improve the further processing steps. According to WO 2013/160867 A1, an acid is applied before an adhesive is applied; for the electrolytic coating of a hot-dip-galvanized surface, U.S. Pat. No. 5,236,574 A teaches alkaline cleaning of the hot-dip-galvanized surface. Plasma treatment is a known solution for the cleaning and activation of surface components ahead of their further-processing. Commercial offerings include cleaning, oxide reduction and pretreatment of a metal substrate by plasma treatment. Typical metals stated are aluminum, aluminum/magnesium alloys, stainless steel, copper alloys or silver alloys.

It is an object of the invention, therefore, to overcome the above-stated disadvantages of the known methods and to provide an alternative to the methods employed to date that can be carried out with existing processes and process windows. In particular, the method is to be optimized for metal coatings based on zinc.

This object is achieved by the method having the features of claim 1.

In accordance with the invention, the method for producing a semifinished product with modified surface comprises the following method steps:

I. providing a striplike or sheetlike steel substrate,

II. at least regionally applying a double-sided metallic coating based on zinc by hot-dip coating, III. skin-pass-rolling, preferably in the coated region, the metallically coated substrate from step II, IV. oiling, preferably in the skin-pass-rolled region, the skin-pass-rolled, metallically coated substrate from step III, V. cleaning, preferably in the oiled region, the oiled, skin-pass-rolled, metallically coated substrate, VI. at least regionally modifying the surface of the cleaned substrate from step V via low-pressure or atmospheric-pressure plasma treatment of said surface regions with oxygen, air, argon, forming gas or a mixture of oxygen and argon, oxygen and air as process gas.

In one configuration of the present invention, in the case of electrolytically galvanized substrates, the skin-pass rolling is carried out before the step of electrolytic galvanizing. A subject of the invention, accordingly, is a method for producing a semifinished product with modified surface, comprising the following method steps:

I. providing a striplike or sheetlike steel substrate,

II. skin-pass-rolling, at least regionally, the metallic substrate from step I,

III. at least regionally applying a double-sided metallic coating based on zinc by electrolysis, preferably in an electrolyte bath, IV. oiling, preferably in the skin-pass-rolled region, the skin-pass-rolled, metallically coated substrate from step III, V. cleaning, preferably in the oiled region, the oiled, skin-pass-rolled, metallically coated substrate, VI. at least regionally modifying the surface of the cleaned substrate from step V via low-pressure or atmospheric-pressure plasma treatment of said surface regions with oxygen, air, argon, forming gas or a mixture of oxygen and argon, oxygen and air as process gas.

Figure 1:
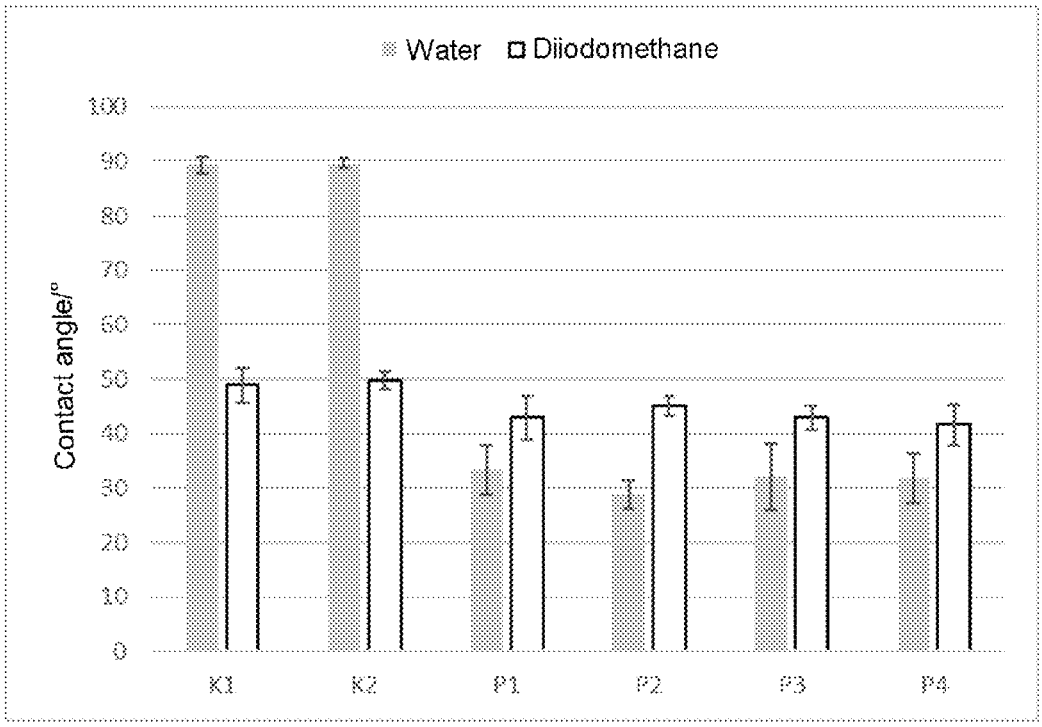
FIG. 1 is a plot showing contact angle according to features ofthe invention.

A striplike steel substrate in accordance with the invention is a substrate which can be provided in the form of a strip, wound up as a coil, for example. A sheetlike substrate is a flat, typically rolled substrate whose thickness is substantially less than its width or length; in particular, steel strips, steel sheets and shapes cut from them, such as blanks and the like. In accordance with the present invention, the semifinished product is subjected to further method steps, including forming steps, for example. A steel substrate is a substrate composed of steel.

A substrate, for the application of a double-sided metallic coating based on zinc, is generally prepared, cleaned for example, preferably in a continuous annealing furnace. In the front, oxidizing part of this furnace, residues of oil and dirt are removed and the steel surface acquires a thin oxide layer. In the following, reducing part of the furnace, this oxide layer has hydrogen removed by reduction. This furnace annealing produces recrystallization, which also does away with the strengthening of the cold-rolled material. The strip is subsequently brought to the temperature of the metal melt and provided in step I for coating.

In the subsequent step II, the strip is hot-dip-coated by being passed through a molten metal bath. The desired coating thickness is adjusted with a nozzle stripping method. The coatings then undergo controlled cooling, with the coating being optionally quenched after the bath. On coating, diffusion of the liquid zinc and possibly further metals of the coating, with the steel surface on the steel part, causes a coating to form, composed of iron-zinc alloy layers of varying composition, possibly containing further metals. Located on the topmost alloy layer is a pure layer consisting of the pure coating, in other words without iron diffusion. In one alternative, the composition of the pure layer corresponds to that of the applied melt.

Following the solidification of the metallic coating, in step III the coated substrate undergoes skin-pass rolling and optionally alignment by stretching or stretching and bending. The elongation rate is typically in the range from 0.3% to 5%. As a result, the surface topography and composition of the coating in the near-surface layers are defined. The surface topography refers in particular to a profile characterized by roughness, number of peaks, and waviness, for example. In one alternative, a surface aftertreatment takes place.

In the case of electrolytically galvanized substrates, first the skin-pass rolling and subsequently the coating are carried out. In contrast to a hot-dip method, the workpiece here to be galvanized is connected as the cathode in a preferably aqueous electrolysis solution. Metallic zinc is used as the anode.

As a further step IV, the substrate is oiled, i.e., provided with surface protection.

In the sense of the invention, the oiled substrate after step IV has the following near-surface layer sequence:

1—pure layer;

2—reaction layer;

3—optionally sorption layer;

4—optionally contamination layer.

The pure layer 1 is the above-described pure layer consisting of the pure coating and any unavoidable impurities such as iron, for example.

The reaction layer 2, with a thickness of 1-100 nm, preferably 50-100 nm, consists of reaction products of the pure layer and is formed by reaction of metals at the surface and optionally the closest underlying layers of atoms of the pure layer on contact with the atmosphere. Accordingly, the reaction layer substantially comprises metal oxides and/or metal hydroxides.

Additives, from lubricants, for example, may also be incorporated into the reaction layer; there may additionally be sulfides and/or carbonates present.

The reaction layer transitions to a sorption layer 3, having a thickness of 0.1-100 nm. This layer comprises accumulations of compounds and/or of colloids or particles in a phase boundary region, between the solid phase of the reaction layer 2 and the surrounding atmosphere as gas phase. This sorption layer 3 is rich in carbon (from hydrocarbons) and in oxygen, and comprises or consists substantially of organic substances, especially esters of carboxylic acids, and optionally water. The compounds and/or colloids or particles of the sorption layer cannot be removed with a simple chemical, nonreactive cleaning, since they are substances which are extraneous to the material and are more difficult to remove than the impurities in the subsequent contamination (impurity) layer.

Following as the outermost layer is the contamination layer 4. With a thickness of at least 0.1 μm, preferably at least 1 μm, more preferably 10 μm up to a maximum of 100 μm, it contains contaminants that are for removal, such as dirt, manufacturing residues and/or previously applied greases and/or oils, for example.

In the sense of the invention, the term "substantially corresponding to" or "substantially identical or equivalent statements" denotes a deviation from a particular mandated value, or a difference between 2 values, of not more than 50%, 45%, 40%, preferably 30%, 25%, more preferably 20%, 19%, 18%, 17%, 16%, 15%, 14%, 13%, 12%, 11%, more particularly 10%, 9%, 8%, 7%, 6%, 5%, 4%, 3%, 2%, 1% or 0.5%, 0.1%. In the description, for example, of the sorption layer as consisting substantially of organic substances, therefore, the mandated value is consisting of 100% organic substances.

In the sense of the invention, the layer thickness or the depth of a layer is always determined from the topmost atom of the respective surface.

The further working of the substrate for the purpose of producing a semifinished product, or for the further production of intermediate products or completed parts, such as by CC or phosphating, for example, necessitates the cleaning of the substrate in step V. The cleaning improves the wettability of the metallic coating with aqueous media. In one alternative, wet-chemical cleaning is carried out. Alkaline, preferably mild alkaline, cleaning agents or organic solvents are employed. One alternative uses one or more agents selected from the group comprising or consisting of the following: mild alkaline cleaning agents having a pH of 9 to 11, preferably 9.5 to 10.5; strongly alkaline cleaning agents having a pH of 12 to 14, preferably 12.5 to 13.0; n-heptane, methyl ethyl ketone, tetrahydrofuran, isopropanol, ethanol, wash benzine (also referred to as white spirit) or a mixture of two or more of said substances; preferably, a mixture of n-heptane with tetrahydrofuran, mixture of n-heptane with ethanol.

This cleaning in one alternative is degreasing.

Further, in one alternative, substantially the contaminants of the contamination layer are removed in this cleaning step, hence substantially the contamination layer is ablated. Nevertheless, residues of oil and/or grease or components thereof may remain on the substrate, especially in the sorption layer.

Cleaning takes place by a spraying or dipping method or in the form of coil coating. Cleaning may take place only regionally in relation to the overall surface of the substrate, on one side of the striplike or sheetlike substrate or on both sides. The treatment takes place preferably in particular, predefined regions or on one side of the substrate, i.e., over the entire area of one side, hence comprehensively.

This is followed in step VI by modification of the surface via plasma treatment. Modification may take place only regionally in relation to the overall surface of the substrate, on one side of the striplike or sheetlike substrate or on both sides. The treatment takes place preferably in particular, predefined regions or on one side of the substrate, i.e., over the entire area of one side, hence comprehensively.

The plasma treatment takes place, in one alternative, at low pressure, i.e., in a vacuum chamber at $10^{-3}$ to $10^{-9}$ bar (10^-3 to 10^-9 bar; preferably with a base pressure P of at least 0.1×10^-4 mbar, 0.5×10^-4 mbar, more preferably 1.0×10^-4 mbar, more particularly 3.0×10^-4 mbar and not more than 100.0×10^-4 mbar, 10.0×10^-4 mbar, more preferably 6.0×10^-4 mbar, more particularly 5.0×10^-4 mbar, and with a test pressure p of at least 0.5×10^-2 mbar, 1.0×10^-2 mbar, more preferably 2.0×10-2 mbar, more particularly 3.0×10-2 mbar and not more than 10.0×10^-2 mbar, 1.0×10^-2 mbar, more preferably 6.0×10^-2 mbar, more particularly 5.0×10^-2 mbar.

The plasma treatment takes place, in one alternative, at atmospheric pressure, i.e., a pressure (air pressure) of at least 750 mbar, preferably 800 mbar, 850 mbar, 900 mbar, more preferably 950 mbar, more particularly 1000 mbar and not more than 1100 mbar, preferably 1070 mbar, 1050 mbar, more preferably 1030 mbar, more particularly 1020 mbar.

Process gas used in the invention in one alternative is air, oxygen or argon. In another alternative, a mixture of air and oxygen, air and argon or oxygen and argon is used. Where air is used as process gas, the plasma treatment in the sense of the invention is a treatment in the atmosphere without the addition of further process gases. A mixture of air and oxygen denotes a plasma treatment in the atmosphere with oxygen enrichment. In one alternative forming gas is used. Where forming gas is used as process gas, the gas mixture used in the sense of the invention is composed of nitrogen and hydrogen, or alternatively of argon and hydrogen. The forming gas used is preferably a gas mixture of nitrogen and hydrogen, with a hydrogen fraction of 1-30%, preferably 1-20%, more preferably 1-10%, more particularly 1-5% hydrogen, the balance being nitrogen. Corresponding gas mixtures are available commercially.

In one alternative, the process gas has a gas flow rate q of at least 10, 15, 20, 25, 50, preferably 100, more preferably 150, more particularly 200 sccm (standard cubic centimeters per minute) and not more than 2000, preferably 1500, preferably 1000, more particularly 600 sccm. In the case of mixtures of different process gases, the sum total of the individual gas flow rates q is in the range described above—for example, a gas flow rate qAr of 200 sccm with a simultaneous gas flow rate qO2 of 400 sccm.

One alternative plasma treatment takes place at room temperature, at least 20° C., not more than 30° C., preferably around 25.0° C.

The plasma treatment at low pressure has a treatment time t of at least 0.5 second, preferably 1, more preferably 5, 10, 20, more particularly 30 seconds and not more than 1200, 900, 600, preferably 300, 180, more preferably 120, more particularly 60 seconds per component.

The plasma treatment at atmospheric pressure is based on the application of the plasma to a substrate by means of devices, referred to as nozzles. The application area of an individual such device (nozzle) is understood in the sense of the invention to be an area region on the substrate that is impinged by the plasma. The treatment time t per unit application area is at least 0.1 second, 0.5 second, preferably 1, preferably 5, 10, 20, more particularly 30 seconds and not more than 300, 180, more preferably 120, 60 seconds, more particularly 30, 20, 10, 5, 3, or 1 second(s). The treatment time t in one alternative is defined via the rate of advance of the device or of the substrate and is at least 0.1 m/min, 1 m/min, preferably 3, 7, 9, 10 m/min, preferably 15, 20 m/min, more particularly 30 m/min and not more than 20, 30 m/min, preferably 35, 40, 45, 50, 60 m/min, more preferably 70, 80, 90 or 100 m/min.

The plasma treatment is further defined by one or more of the following features:

- a power P of at least 0.1, preferably 0.2, more preferably 0.3, more particularly 0.4 kW and not more than 10.0, 7.5, 5.0, 2.5 or 2.0, preferably 1.0, more preferably 0.8, more particularly 0.6 kW;
- a frequency f of at least 5, 10, 20, 30, 40 or 50, preferably 100, more preferably 150, more particularly 180 Hz and not more than 500, preferably 300, more preferably 250, more particularly 220 Hz;
- a current strength I of at least 1.00 A, preferably 1.50, more preferably 2.00, more particularly 2.50 A and not more than 4.0 A, preferably 3.50, more preferably 3.0, more particularly 2.60 A, and also
- a voltage U of at least 100 V, preferably 120, more preferably 150, more particularly 180 and not more than 300 V, preferably 280, more preferably 250, more particularly 220 V.

A characteristic of the modification of the surface by plasma treatment in accordance with the invention is the removal of carbon and carbon-containing components from the surface of the substrate, with the chemical composition of the reaction layer 2 (see above) remaining substantially the same in relation to a control without the plasma treatment of the invention. In other words, the respective fractions of metals and their oxides and/or hydroxides remain constant and are not changed by the plasma treatment. In one alternative, the plasma treatment removes the carbon-containing residual coverings, including those in the form of organic compounds, from the reaction layer. In one alternative, therefore, a substrate is present with a coating and hence also a reaction layer of the same composition as before the oiling.

In one alternative, the plasma treatment is additionally characterized in that the surface topography remains constant in relation to a control without the plasma treatment of the invention.

An untreated control in the sense of the invention is a substrate with metallic coating but including the coating is identical to the sample used in accordance with the invention; in other words, the control has passed through the same processes and production steps except for the plasma treatment for use in accordance with the invention. The sole difference between the control and the substrate used in the invention is that the control is not subjected to plasma treatment for use in accordance with the invention.

In one configuration, the steel substrate is coated with a metallic coating, based on Zn, ZnMg, ZnAl and/or ZnMgAl. A hot-dip coating bath particularly suitable for the purposes of the invention, and a corresponding metallic coating on the substrate, comprise or consist in one alternative of Zn and unavoidable impurities. In another alternative, a hot-dip coating bath and a corresponding metallic coating comprise or consist of between 0.1 and 10.0 wt % of magnesium and/or between 0.1 and 20.0 wt % of aluminum, preferably at least 0.3 wt %, 0.5 wt % of magnesium, more preferably 1.0 wt % of Mg, more particularly 2.0 wt % of Mg and not more than 4.0 wt % of magnesium, more preferably 3.0 wt % of Mg, more particularly 2.5 wt %, 2.0 wt % of Mg and/or at least 0.5 wt % of Al, more preferably 0.7 wt % of Al, 1.0 wt % of Al, more particularly 2.0 wt % of Al and not more than 11.0 wt % of Al, more preferably 6.0 wt % of Al, 4.0 wt % of Al, 3.0 wt % of Al, more particularly 2.0 wt % of Al, with the balance being Zn and unavoidable impurities. The Mg/Al ratio by mass is preferably less than or equal to 1, more preferably less than 0.9.

In a further alternative, the hot-dip coating bath and the corresponding metallic coating may contain up to 0.3 wt % of any of the optional additional elements, selected from the group comprising or consisting of Si, Sb, Pb, Ti, Ca, Mn, Sn, La, Ce, Cr, Ni, Zr and Bi. Furthermore, there may also be residues of further elements present, originating for example from the preceding steps, or unavoidable impurities.

The concentrations of the individual elements in the coating differ in near-interface layers from the concentrations in the hot-dip coating bath. Particularly in near-surface layers such as the reaction layer, the ratio in which the individual elements are present differs from that of the hot-dip coating bath.

In the alternatives with an Mg-containing coating based on Zn, the magnesium-rich oxide layer in combination with the components of the oil, especially esters, is responsible in particular for poor wetting behavior by process media in the further surface treatment steps.

To enable sufficient corrosion protection, the zinc-based coating of the steel substrate according to one embodiment has an add-on of at least 20 g/m2, preferably 30 g/m2, 40 g/m2, 50 g/m2, 60 g/m2, 70 g/m2, 80 g/m, 90 g/m2, 100 g/m2 or 120 g/m2, more particularly from at least 40 g/m2 to not more than 300 g/m2, 200 g/m2, preferably 150 g/m2, more preferably 120 g/m2, 100 g/m2, more particularly 90 g/m2, 80 g/m2 per side on one or both sides, preferably comprehensively. Hence coatings with a thickness of at least 0.5 μm, 1.0 μm, 2.0 μm or 3.0 μm, preferably 4.0 μm, 5.0 μm or 6.0 μm, more particularly of at least 7.0 μm, 8.0 μm, 9.0 μm or 10.0 μm up to not more than 10.0 μm, 12.0 μm, 15.0 μm, 20.0 μm, preferably 25.0 μm, 30.0 μm, more preferably 35.0 μm, 40.0 μm more particularly 50.0 μm or more per side are applied on one or both sides, preferably comprehensively.

In a further configuration of the invention, after at least one of the steps I, III, IV, V and/or VI, the striplike substrate is wound up to form a coil, to be supplied or is supplied to the downstream working steps. To implement the following working step, the coil is unwound correspondingly.

The winding and unwinding do not alter the results of the preceding steps, this hence being a further feature of the substrate or semifinished product.

One configuration relates to the method which after step IV, of oiling—which in this configuration may be referred to as IV.a—comprises an aging step IV.b. The aging step comprises one or more of the following substeps: distribution of the oil over the surface topography of the substrate, winding, storage, transport to the customer, unwinding, etc. The aging step lasts at least 0.5 hour, 1.0, 6.0, 12.0 or 24.0 hours up to two or more (at least 2) days, weeks, months or years. The effect of the aging is relevant for the near-surface layers of the substrate, since in spite of oiling there may be an oxide layer (reaction layer -2-) of up to 200 nm formed. The metallic phases lying beneath this layer are likewise oxidized as a result. Typical cleaning is therefore not sufficient for subsequent, comprehensive hydrophilic wetting.

In one configuration, there is a further surface treatment step VII after the modification of the surface in step VI. The modification of the surface in step VI modifies the surface of the cleaned substrate such that disruptive components are removed and optionally the surface is activated, allowing a uniform, homogeneous wetting to take place. The plasma treatment is preferably performed immediately directly before the subsequent surface treatment step, preferably a chemical aftertreatment. The length of time for which the surface is activated by the plasma treatment, and remains reactive, is dependent on the duration of the timespan between the two steps. The longer the treatment time, the longer a surface remains active. In particular, between plasma treatment and aftertreatment, the steel substrate comes into contact with as few deflecting rollers as possible. The time intervals between the treatment steps are less than 300 s, 180 s, preferably 120 s, 90 s, 60 s, more preferably 45 s, 30 s, 25 s, 20 s, more particularly 15 s, 10 s, 5 s, 1 s.

In one alternative, a coil-coating method is carried out as a further surface treatment step VII-i. For this purpose, after step VI, a pretreatment for coil coating is carried out first, as step VII-i-a. The pretreatment comprises, for example, a chemical passivation known to the skilled person or another or further pretreatment, such as application of adhesion promoter, activating agent and/or passivating agent. The plasma treatment before the application of pretreatment media ensures improved wetting behavior of the respective pretreatment in comparison to a control without plasma treatment, and so ensures stronger/more homogeneous attachment of the layers for subsequent application, such as a more stable paint system, for example.

The coil-coating method is carried out subsequently as step VII-i-b. The paint system, optionally in a number of layers such as, for example, primer, topcoat and/or clearcoat, is applied in a roll method and baked at about 240° C. The paint may be protected by means of a lining film. Lastly, the continuous painted substrate/semifinished product is wound up to form a coil. Alternatively, the coil may be separated into unit lengths, optionally prior to lining.

In one configuration, after the skin-pass rolling in step III, the surface of the skin-pass-rolled substrate from step III is modified via at least regional plasma treatment of the surface in a step III-ii-a and optionally a step III-ii-b of pre- and/or aftertreatment. This and also the plasma treatment take place as described above.

A further configuration relates to a method comprising steps I to VII and optionally step III-ii-a and optionally step III-ii-b, in which before the cleaning in step V—which in this configuration may be referred to as V-ii-b—at least one step V-ii-a is carried out, selected from the group of the methods comprising or consisting of cutting, forming, joining, degreasing, activating, phosphating, cathodic dip-painting and painting. Joining here may in turn be spot welding, adhesive bonding, and laser soldering.

In this configuration, in one alternative, as further surface treatment step VII-ii-a, after the plasma treatment VI, activation of the surface is carried out. Here, the surface of the plasma-treatment substrate is placed in a condition which is amenable to chemical reaction. Through the contact of the plasma-treated substrate with an acidic or alkaline medium, metal ions are detached from the surface. They are then able to enter into bonds with constituents of the solution. The activation takes place frequently using dilute phosphoric acid compounds or specific compounds which act like seed crystals. The activation serves for the following phosphating, which in this alternative takes place as further surface treatment step VII-ii-b.

In one configuration of the method, the relative concentration of in a surface-bordering layer of the metallic coating, with a thickness equal to the typical XPS information depth, after between step III and after step VI is substantially the same.

The relative concentration of C, O, Mg and/or Zn is determined in the sense of the invention by determining the absolute concentration of these elements and then standardizing to 100%; here, the sum total of the concentration of these elements is set at 100 and the fraction of the respective element is rated or weighted as a relative concentration to this 100%, in other words based on 100%. The relative concentration of an element therefore is based on the sum total of the concentrations of the 4 elements, with this sum total representing 100%. Given that the absolute concentration of the elements may vary from coating to coating, it is stated generally in accordance with the invention as a relative concentration and in percentage points, in order to give a precise definition of the changes.

Here, the occurrence of the elements in the sense of the invention is captured independently of the form in which they are present; accordingly, it is irrelevant whether these elements are present as neutral atoms or as ions, in an assembly such as, for example, an alloy or intermetallic phases, or in a compound such as, for example, complexes, oxides, salts, hydroxides or the like.

In the sense of the invention, the typical XPS information depth corresponds to a layer having a thickness of substantially 5 nm. In accordance with the invention, the XPS measurement is made with an instrument as follows: Phi Quantera II SXM Scanning XPS Microprobe from Physical Electronics GmbH. (The general parameters of the instrument are as follows: operating pressure in main chamber: $<1\times10-6$ Pa; lock pressure: $<2.7\times10-4$ Pa; x-ray source: Al 1486.6 eV monochromatic; maximum sample size: 70 mm×70 mm×15 mm (height); neutralizing agents: Ar and electrons; neutralization voltage: 1.5 V; neutralization current strength: 20.0 μA; beam diameter: 100 μm; pass energy: 280 eV; spectral resolution: 1 eV.) A subject of the invention is a semifinished product with modified surface, produced in a method as described above.

A further subject of the invention is the use of low-pressure or atmospheric-pressure plasma treatment with oxygen, air, argon, forming gas or a mixture of oxygen and argon, oxygen and air as process gas for re-establishing a surface of a skin-pass-rolled, metallically coated substrate after oiling and cleaning of the substrate. The individual steps of plasma treatment, skin-pass rolling, metallic coating, oiling and cleaning are described in detail above.

Plasma treatment with oxygen, air, argon, forming gas or a mixture of oxygen and argon, oxygen and air as process gas improves the wettability of metallically coated steel by aqueous media, by ablating residual carbon coverings which remain in the case of the standard cleaning.

The improved wettability may be utilized for the coil-coating process, for achieving a more uniform coating outcome. Through the modification of the surface via plasma treatment, it is possible, when using the existing instruments and processes, to achieve a streak-free result. The effect of the plasma treatment may be utilized for any aqueous chemical treatments, both in the automobile process and in the coil-coating process.

In the sense of the invention, combinations of the above-described configurations and alternatives may also be used.

EXAMPLES

Example 1

A skin-pass-rolled substrate coated on a ZnMgAl basis as described above was produced and was degreased using organic solvent (combination of n-heptane with isopropanol, n-heptane with ethanol or ethanol with isopropanol). Plasma treatment took place with oxygen as process gas as described in table 1 for increasing the water wettability. Wettability was determined via the contact angle of water and diiodomethane; the control (K) used was an identically prepared metal sheet, but without plasma treatment.

TABLE 1

| Sample | Degreasing | Plasma treatment |
|---|---|---|
| P1 | n-heptane, isopropanol | f = 15 sccm, L = 50 W, t = 15 min |
| P2 | n-heptane, isopropanol | f = 15 sccm, L = 50 W, t = 5 min |
| P3 | n-heptane, ethanol | f = 15 sccm, L = 50 W, t = 5 min |
| P4 | n-heptane, ethanol | f = 15 sccm, L = 50 W, t = 10 min |

The results are represented in FIG. 1. From this it is clear that the plasma treatment significantly increases the wettability. The plasma treatment generally increases the wettability significantly, in other words not only for water. This means that the modification of the surface by plasma leads to a surface which is wettable effectively by polar liquids. Since the effect occurs even after the shortest treatment time of 5 min, meaning that the carbon-containing residual coverings are completely ablated, there is no difference in wettability achievable by longer treatment time.

The water contact angle of P1 was measured immediately after plasma treatment (P1-0), after 1 day (P1-1), 2 days (P1-2) and after 2 weeks (P1-3).

Figure 2:
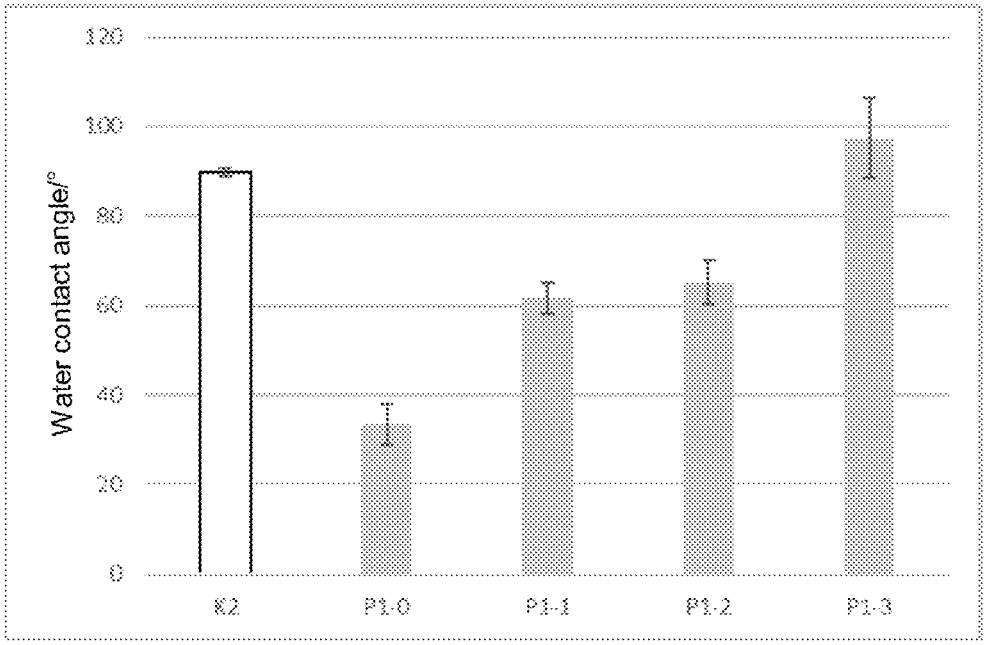
FIG. 2 is a plot showing water contact angle according to features of the invention.

The results are represented in FIG. 2.

From this it is clear that through environmental contact and renewed soiling of the surface, the effect of the plasma treatment is reduced again.

Example 2

A coated substrate skin-pass-rolled as described above and galvanized on the basis of Zn (Z1) or ZnMgAl (ZM1 and ZM2) and also electrolytically (ZE1) was oiled with the anticorrosion oil PL3802-39S from Fuchs and subjected to alkaline degreasing with Ridoline 1340 from Henkel. Plasma treatment took place with argon or oxygen-argon mixture as process gas, as described above, for increasing the wettability. The wettability was determined via the contact angle with water and diiodomethane immediately after plasma treatment; serving as control (K) was an identically prepared metal sheet, but without.

The precise parameters are summarized in table 2:

| Sample | Cleaning | Base pressure p [10^−4 mbar] | Test pressure P [10^−2 mbar] | q Ar [sccm] | q O2 [sccm] | L [kW] | t [sec] |
|---|---|---|---|---|---|---|---|
| ZM1 | Mild | 3 to 6 | 4 | 200 | 400 | 0.5 | 60 |
| Z1 | alkaline | | | | | | |
| ZE1 | | | | | | | |
| ZM2 | | | | 600 | 0 | | |

Figure 3:
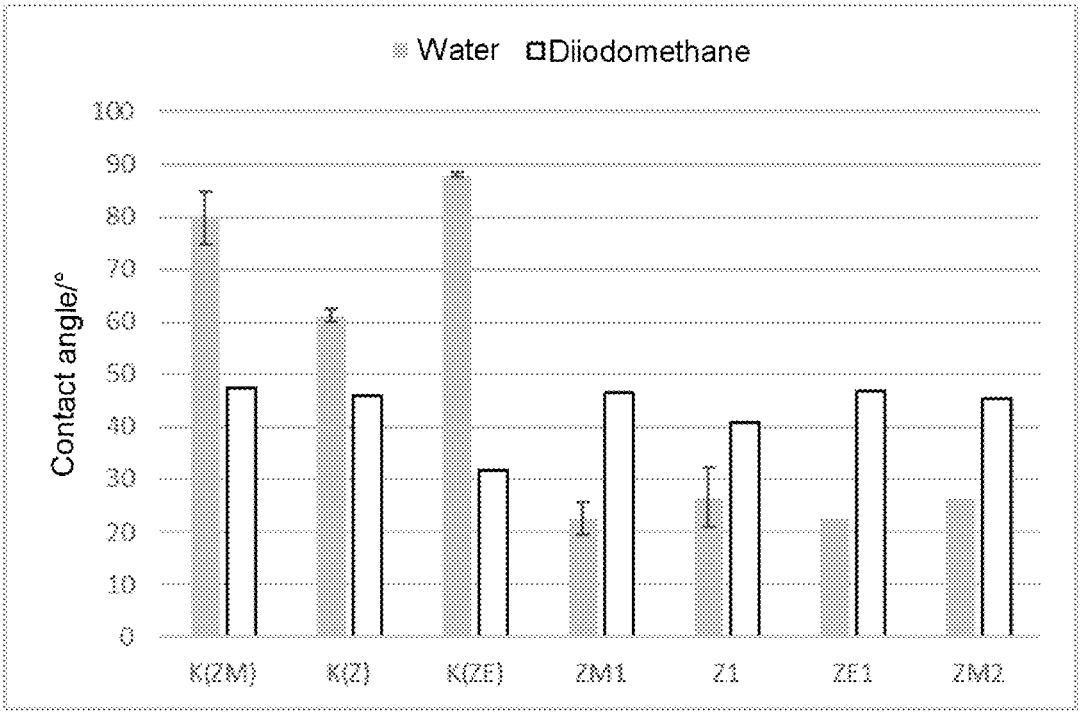
FIG. 3 is another plot showing water contact angle according to features of the invention.

The results are represented in FIG. 3. From this it is clear that the plasma treatment generally increases the wettability significantly and that not only argon but also oxygen-argon mixtures are suitable for conditioning the wettability. For Zn and ZnMgAl coatings, an improvement in wettability in analogy to the pure oxygen plasma treatment is evident.

Example 3

Investigating the Effect of the Plasma Treatment on Coil-Coating Process 15 respective substrates skin-pass-rolled as described above and coated on a ZnMgAl basis were produced and were oiled with the anticorrosion oil PL3802-39S from Fuchs. Of these substrates, 10 were degreased using alkali and 5 with MEK (methyl ethyl ketone). Additionally, five of the substrates degreased with alkali underwent plasma treatment with oxygen-argon mixture as process gas, as described above, for increasing the wettability. Parameters: base pressure between 3 and 6*10^−4 mbar, test pressure 4*10^−2 mbar, qAr 200 sccm, q O2 400 sccm, L=0.5 kW, treatment time 60 s.

Via a coil-coating line, all of the substrates were coated as pretreatment with an adhesion promoter (adhesion promoter GBX 4537).

A thermal imaging camera was used to represent the wet film of the pretreatment solution directly after coating.

In the case of the semifinished products without plasma treatment, the wet film extensively appeared to be regular, but fine transverse streaks were observed in the wet film, which remained after drying.

The uniformity of the layer of adhesion promoter was assessed by giving it a dark staining with copper sulfate solution. In the case of the semifinished products without plasma treatment, wetting defects were observed.

The semifinished products subjected to plasma treatment produced a unitary, full-area, homogeneous wetting without defects.

Evaluation took place visually.

The invention claimed is:

1. A method for producing a semifinished product with modified surface, comprising the following method steps:

I. providing a steel substrate with strip or sheet metal,

II. at least regionally applying a double-sided metallic coating based on zinc by hot-dip coating the substrate from step I, III. skin-pass-rolling the metallically coated substrate from step II, IV. oiling the skin-pass-rolled, metallically coated substrate from step III, V. at least regionally cleaning the substrate from step IV, VI. at least regionally modifying the surface of the cleaned substrate from step V via low-pressure or atmospheric-pressure plasma treatment of said surface regions with oxygen, air, argon, forming gas or a mixture of oxygen and argon, oxygen and air as process gas.

2. The method as claimed in claim 1 wherein the steel substrate is coated with a metallic coating, based on Zn, ZnMg, ZnAl and/or ZnMgAl.

3. The method as claimed in claim 1 wherein the substrate after at least one of the steps I, skin-pass rolling II or III, IV, V and/or VI, is wound up to form a coil, for supply to or is supplied to the downstream working step(s).

4. The method as claimed in claim 1 wherein the method after oiling step IV comprises an aging step IV.B.

5. The method as claimed in claim 4 wherein after the modifying of the surface in step VI, a further surface treatment step VII is carried out.

6. The method as claimed in claim 5, further comprising: further surface treatment step VII-i, including a coil-coating.

7. The method as claimed in claim 6, wherein after step VI, first a pretreatment for coil coating, as step VII-i-a, and subsequently the coil-coating method, as step VII-i-b, are carried out.

8. The method as claimed in claim 5 wherein after the skin-pass rolling in step III, modification of the surface of the skin-pass-rolled substrate from step III is carried out via at least regional plasma treatment of the surface in a step III-ii-a and optionally a step III-ii-b of pre-and/or aftertreatment.

9. The method as claimed in claim 5 wherein before the cleaning in step V (now V-ii-b), at least one step V-ii-a is carried out, selected from the group of the methods consisting of cutting, forming, joining, degreasing, activating, phosphating, cathodic dip-painting, and painting.

10. The method as claimed in claim 9, wherein a further surface treatment step VII-ii-a, activation of the surface is carried out.

11. The method as claimed in claim 10, wherein a further surface treatment step VII-ii-b, phosphating of the surface is carried out.

12. The method as claimed in claim 11 wherein the relative concentrations of C, O, Mg and/or Zn in a surface-bordering layer of the metallic coating, with a thickness equal to the typical XPS information depth, are substantially the same after between step III and after step VI.

13. A semifinished product produced in a method as claimed in claim 12.

* * * * *